US008413549B2

(12) United States Patent
Chen

(10) Patent No.: US 8,413,549 B2
(45) Date of Patent: Apr. 9, 2013

(54) REVOLVING SCREWDRIVER WITH RATCHET STRUCTURE

(76) Inventor: Yi Jhen Chen, Taichung (TW)

( * ) Notice: Subject to any disclaimer, the term of this patent is extended or adjusted under 35 U.S.C. 154(b) by 442 days.

(21) Appl. No.: 12/907,007

(22) Filed: Oct. 18, 2010

(65) Prior Publication Data

US 2012/0090434 A1 Apr. 19, 2012

(51) Int. Cl.

| | |
|---|---|
| ***B25B 13/46*** | (2006.01) |
| ***B25B 13/52*** | (2006.01) |
| ***B25B 13/00*** | (2006.01) |
| ***B25B 21/00*** | (2006.01) |
| ***B25B 23/157*** | (2006.01) |
| ***B25B 23/142*** | (2006.01) |
| ***B25B 23/159*** | (2006.01) |
| ***B25B 15/00*** | (2006.01) |
| ***B25B 23/00*** | (2006.01) |
| ***B25B 23/08*** | (2006.01) |
| ***B25B 23/10*** | (2006.01) |

(52) U.S. Cl.

USPC ..... 81/62; 81/60; 81/61; 81/177.2; 81/52; 81/473; 81/478; 81/436; 81/438; 81/439; 81/452; 81/448; 81/447; 81/451; 81/458; 81/457; 81/460; 81/461; 81/64

(58) Field of Classification Search ..... 81/62, 60, 81/61.1, 177.2, 52, 473, 478, 436, 438, 439, 81/81/452, 448, 447, 451, 458, 457, 460, 81/461, 64

See application file for complete search history.

(56) References Cited

U.S. PATENT DOCUMENTS

| | | | | |
|---|---|---|---|---|
| 4,976,175 | A * | 12/1990 | Hung | 81/439 |
| 6,502,484 | B2 * | 1/2003 | Pao-Hsi | 81/439 |
| 6,601,483 | B2 * | 8/2003 | Wannop | 81/490 |
| 7,039,975 | B1 * | 5/2006 | Liao | 7/165 |
| 7,237,458 | B2 * | 7/2007 | Shiao | 81/62 |
| 7,565,852 | B2 * | 7/2009 | Yu | 81/177.4 |

* cited by examiner

*Primary Examiner* — Monica Carter
*Assistant Examiner* — Danny Hong

(57) ABSTRACT

A revolving screwdriver with ratchet structure includes a handle, a pushing rod, and a sliding member. The sliding member has a receiving space and a holding chamber defined therein. A revolving cylinder is received in the holding chamber. The receiving space receives at least one ratchet wheel, two rotators, a limiting member, a base, and an adjuster. The at least one ratchet wheel engages with a driving shaft. The rotators selectively engage with the at least one ratchet wheel. The limiting member locates between the rotators and has a protrusion formed thereon. A base has a first guiding slot defined therein. The adjuster has a driving hole defined therein. The protrusion passes through the first guiding slot and the driving hole for being driven by the adjuster and moving along the first guiding slot.

4 Claims, 5 Drawing Sheets

REVOLVING SCREWDRIVER WITH RATCHET STRUCTURE

BACKGROUND OF THE INVENTION

1. Field of the Invention

The present invention relates to a revolving screwdriver with ratchet structure, and more particularly to a revolving screwdriver being able to control a rotating direction of a driving shaft.

2. Description of Related Art

A conventional revolving screwdriver in accordance with the prior art comprises a hollow handle and a forward device which has a hollow, cylindrical seat and a driving shaft disposed thereon. The hollow handle comprises a revolving cylinder having a plurality of axial, periphery shank cartridges for correspondingly receiving a plurality of shanks, and a push rod which is adapted to push the shank out of the corresponding cartridge into the driving shaft. The driving shaft is hollow and comprises a front end which has a section of hexagon, a rear end which has a section of circle, and a guide in the rear end thereof. The guide is aligned with a flat surface extended inwardly from the front end of the driving shaft, such that it can automatically align one shank pushed out of the revolving cylinder with the forward end of the driving shaft prior to pushing the shank out of the driving shaft for use.

However, the conventional revolving screwdriver provides for easily interchanging shanks, but it is not able to control the rotating directions of the revolving shaft as the shank is pushed to the forward end of the driving shaft. Therefore, during operating of the conventional revolving screwdriver, the user would inconveniently drive and rotate the shank of conventional revolving screwdriver.

The present invention has arisen to mitigate and/or obviate the disadvantages of the conventional revolving screwdriver.

SUMMARY OF THE INVENTION

The main objective of the present invention is to provide an improved revolving screwdriver with ratchet structure.

To achieve the objective, the revolving screwdriver with ratchet structure includes a handle for adapting to be gripped by a user, a pushing rod axially connected to the handle, and a sliding member axially and slidably connected to the pushing rod. The sliding member has a sliding hole axially defined therein and extending therethrough for sleeving on the pushing rod. The sliding member has a receiving space axially defined in one end thereof and the sliding hole is formed an opening in a bottom of the receiving space. A recess is laterally defined therein and communicates with the receiving space. The sliding member has a holding chamber axially defined therein and located adjacent to the receiving space. The holding chamber communicates with the sliding hole.

A revolving cylinder is rotatably and axially received in the holding chamber. The revolving cylinder has a center hole axially defined therein and extending therethrough for pivotally assembling within the holding chamber. The revolving cylinder has a plurality of containing holes axially defined therein and extending therethrough. Each containing hole adapts to receive a tool bit. The containing holes are radially spaced around the center hole. Each containing hole is able to selectively align with the sliding hole and the opening. The revolving cylinder is rotatable relative to the sliding member for changing to the desired tool bit.

A retainer is disposed in a bottom of the receiving space. The retainer has two bores axially and respectively defined in two sides thereof At least one ratchet wheel is rotatably received in the receiving space and located exterior of the retainer. The at least one ratchet wheel has a through hole axially defined therein and aligned with the opening of the sliding member. The through hole has a plurality of grooves axially defined in an inner periphery thereof Two rotators are pivotally received in the receiving space for selectively engaging with the at least one ratchet wheel. The two rotators respectively and pivotally engage with the two bores of the retainer. Two springs are compressibly received in the receiving space and are respectively connected to the two rotators. Each spring has two ends respectively abutting against an inner periphery of the receiving space and the corresponding rotator. A limiting member is pivotally received in the receiving space and located between the two rotators for selectively pressing one of the two rotators toward the inner periphery of the receiving space. The limiting member has a protrusion axially formed thereon.

A base is received in the receiving space. The at least one ratchet, the limiting member, the two rotators and the two springs are located between the base and the retainer. The base has an arc-shaped first guiding slot, a limiting hole, and a pivot hole defined therein and axially extending therethrough. The limiting hole is located between the first guiding slot and the pivot hole. The limiting member is pivotally engaged with the limiting hole and the protrusion passes through the first guiding slot for moving along the first guiding slot. An adjuster is movably received in the receiving space and located exterior of the base. The adjuster has a pivot end pivotally engaged with the pivot hole of the base. The adjuster has a driving hole defined therein and axially extending therethrough. The protrusion of the limiting member passes through the driving hole for being driven by the adjuster. The adjuster has an arc-shaped teeth portion laterally formed thereon and located opposite to the pivotal end. The teeth portion protrudes from the recess of the sliding member.

A cover is disposed on the sliding member for sealingly covering the receiving space. The cover has a shaft hole axially defined therein and extendingly communicating with the receiving space. The shaft hole is coaxial with the through hole of the at least one ratchet wheel and the opening of the sliding member. The cover has a pivot pin formed thereon and axially extending toward the base. The pivot pin sequentially passes through the pivotal end of the adjuster and the pivot hole of the base for connecting the cover, the adjuster and the base together. The cover has a second guiding slot defined therein and located corresponding to the first guiding slot of the base. The second guiding slot has a shape corresponding to the first guiding slot. The protrusion of the limiting member passes through the second guiding slot via the first guiding slot for moving along the second guiding slot. The cover has two directional indicators respectively disposed on two ends of the second guiding slot.

A driving shaft sequentially passes through the shaft hole of the cover, the base, the through hole of the at least one ratchet wheel to be rotatably connected to the sliding member. A rotating direction of the driving shaft is indicated by the two directional indicators. The driving shaft is partially received in the receiving space and axially aligned with the opening One end of the driving shaft has a plurality of flanges annularly formed on an outer periphery thereof and annularly located around the outer periphery thereof for correspondingly engaging with the grooves of the at least one ratchet wheel.

During operation, when the sliding member axially slides relative to the pushing rod. The pushing rod relatively moves along the sliding hole and the aligned containing hole of the revolving cylinder to push the corresponding tool bit into the driving shaft. When the adjuster is pivotally moved about the driving shaft, the protrusion of the limiting member is driven by the adjuster to move along the first guiding slot of the base, one of the two rotators is pressed to compress the corresponding spring by the limiting member for disengaging the at least one ratchet wheel, such that the driving shaft is able to pivotally move with the at least one ratchet wheel in the corresponding rotating direction and ratchetably drives the desired tool bit.

Further benefits and advantages of the present invention will become apparent after a careful reading of the detailed description with appropriate reference to the accompanying drawings.

DETAILED DESCRIPTION OF THE INVENTION

Figure 1:
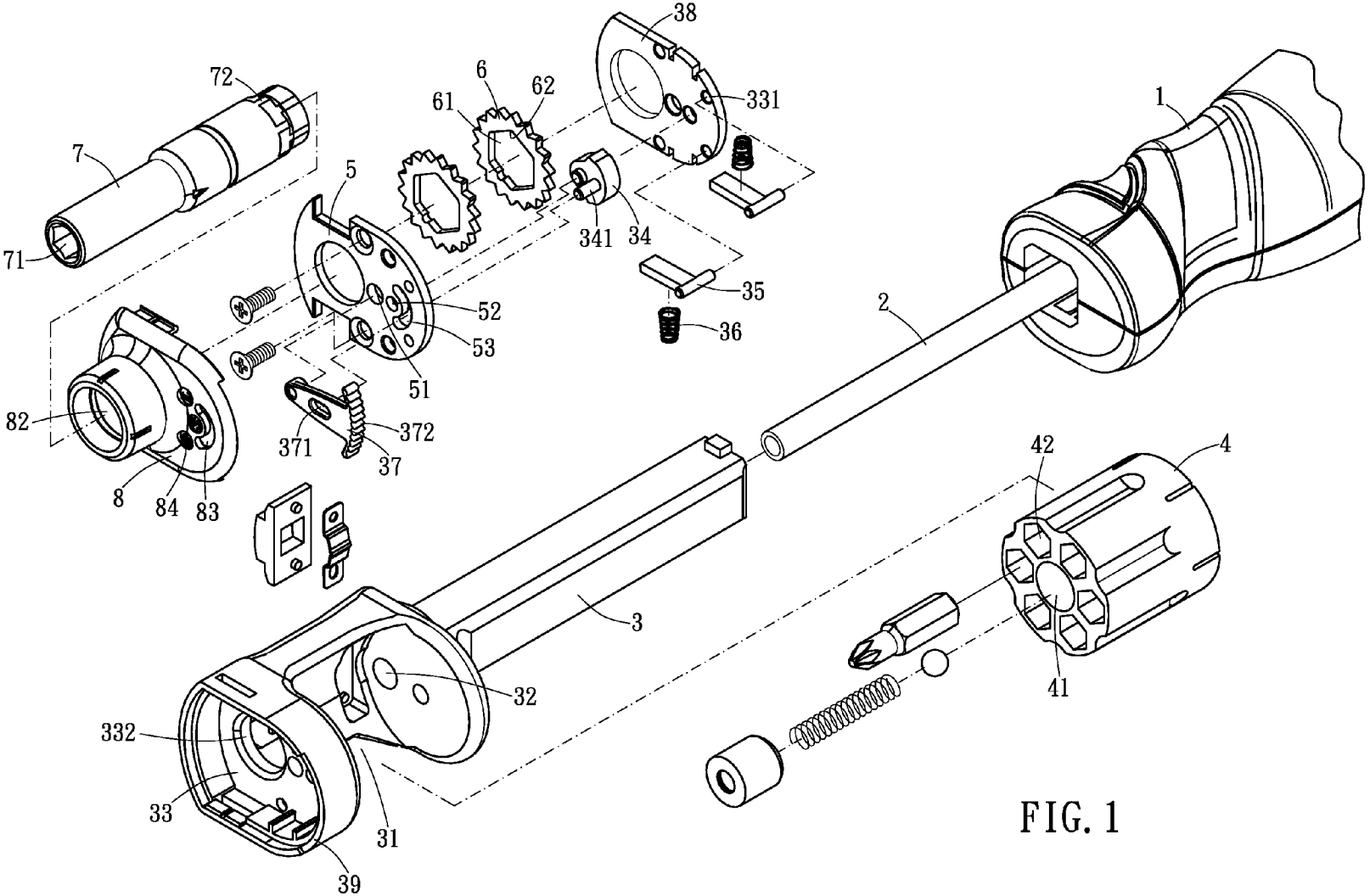
FIG. 1 is an exploded perspective view of a revolving screwdriver with ratchet structure in accordance with the present invention.
Figure 2:
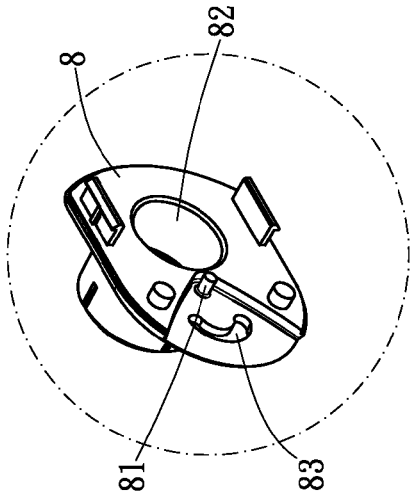
FIG. 2 is a perspective rear view of a cover of the revolving screwdriver with ratchet structure in accordance with the present invention.
Figure 3:
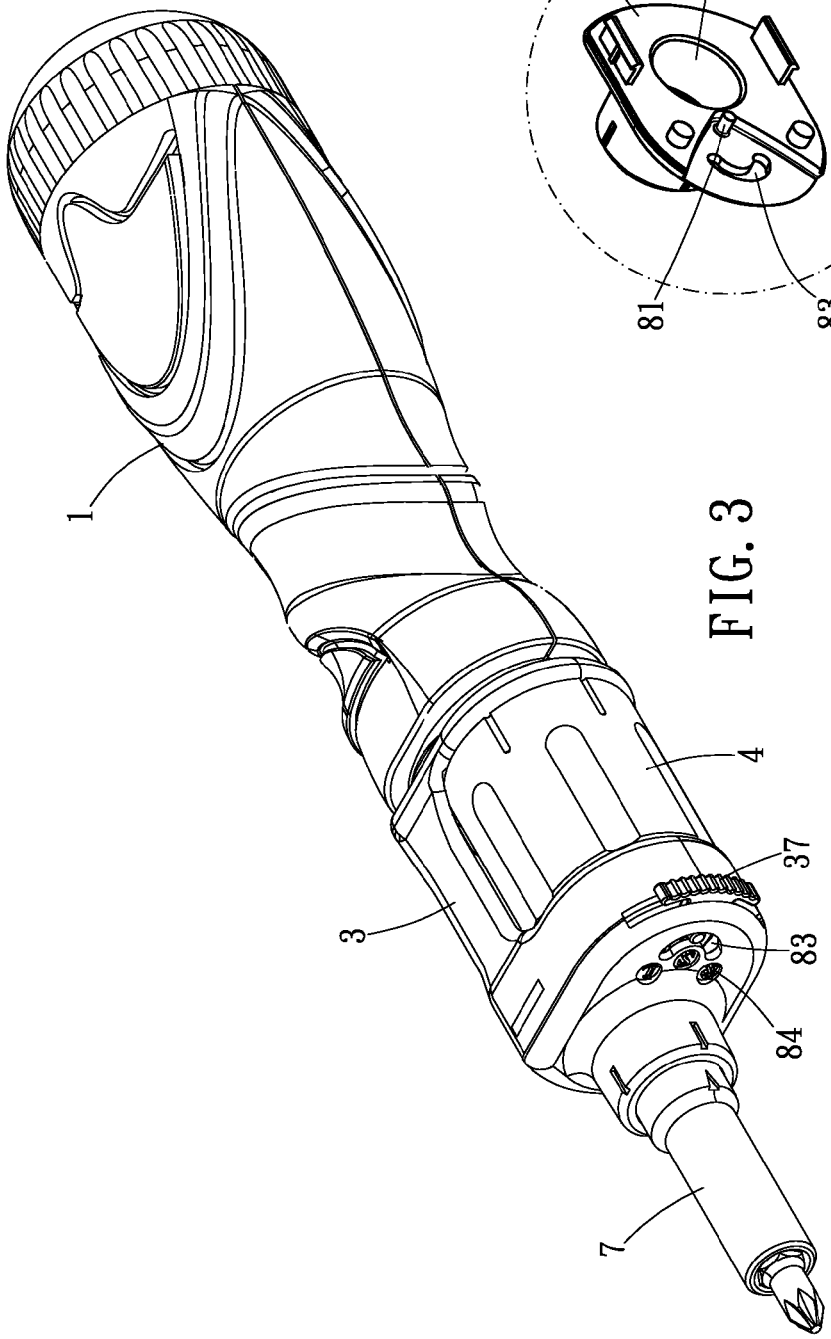
FIG. 3 is an assembled perspective view of the revolving screwdriver with ratchet structure in accordance with the present invention.

Referring to the drawings and initially to FIGS. 1-3, a revolving screwdriver with ratchet structure in accordance with a preferred embodiment of the present invention comprises a handle 1 for adapting to be gripped by a user, a pushing rod 2 axially connected to the handle 1, and a sliding member 3 axially and slidably connected to the pushing rod 2. The sliding member 3 has a sliding hole 32 defined therein and axially extending therethrough for sleeving on the pushing rod 2. The sliding member 3 has a receiving space 33 axially defined in one end thereof and the sliding hole 32 is formed an opening 332 in a bottom of the receiving space 33. The receiving space 33 is located opposite to the handle 1. A recess 39 is defined in a lateral wall of the receiving space 33 and communicates with the receiving space 33. The sliding member 3 has a holding chamber 31 axially defined therein and located adjacent to the receiving space 33. The holding chamber 31 communicates with the sliding hole 32 and the opening 332.

A revolving cylinder 4 is rotatably and axially received in the holding chamber 31. The revolving cylinder 4 has a center hole 41 defined therein and axially extending therethrough for pivotally assembling within the holding chamber 31. The revolving cylinder 4 has a plurality of containing holes 42 defined therein and axially extending therethrough for adapting to receive tool bits (not numbered) of different sizes or types. Each containing hole 42 adapts to receive one tool bit. The containing holes 42 are radially spaced around the center hole 41. Each containing hole 42 is able to selectively align with the sliding hole 32 and the opening 332, such that the revolving cylinder 4 is rotatable relative to the sliding member 3 for changing to the desired tool bit.

A retainer 38 is disposed in a bottom of the receiving space 33. The retainer 38 has two bores 331 axially and respectively defined in two sides thereof At least one ratchet wheel 6 is rotatably received in the receiving space 33 and located exterior of the retainer 38. The at least one ratchet wheel 6 has a through hole 61 axially defined therein and aligned with the opening 332 of the sliding member 3. The through hole 61 has a plurality of grooves 62 axially defined in an inner periphery thereof Two rotators 35 are pivotally received in the receiving space 33 for selectively engaging with the at least one ratchet wheel 6. The two rotators 35 respectively and pivotally engage with the two bores 331 of the retainer 38. Two springs 36 are compressibly received in the receiving space 33 and are respectively connected to the two rotators 35. Each spring 36 has two ends respectively abutting against an inner periphery of the receiving space 33 and the corresponding rotator 35. Each spring 36 provides a resilient force for pushing the corresponding rotator 35 toward the at least one ratchet wheel 6. A limiting member 34 is pivotally received in the receiving space 33 and located between the two rotators 35 for selectively pressing one of the two rotators 35 toward the inner periphery of the receiving space 33. The limiting member 34 has a protrusion 341 axially formed thereon and extending outwardly therefrom.

A base 5 is received in the receiving space 33. The at least one ratchet 6, the limiting member 34, the two rotators 35, and the two springs 36 are located between the base 5 and the retainer 38. The base 5 has an arc-shaped first guiding slot 53, a limiting hole 52, and a pivot hole 51 defined therein and axially extending therethrough. The limiting hole 52 is located between the first guiding slot 53 and the pivot hole 51. The limiting member 34 is pivotally engaged with the limiting hole 52 and the protrusion 341 passes through the first guiding slot 53 for moving along the first guiding slot 53. An adjuster 37 is movably received in the receiving space 33 and located exterior of the base 5. The adjuster 37 has a pivot end pivotally engaged with the pivot hole 51 of the base 5. The adjuster 37 has a driving hole 371 defined therein and axially extending therethrough. The protrusion 341 of the limiting member 34 passes through the driving hole 371 for being driven by the adjuster 37. The adjuster 37 has an arc-shaped teeth portion 372 laterally formed on one end thereof and located opposite to the pivotal end. The teeth portion 372 protrudes from the recess 39 of the sliding member 3 for being easily operated by the user.

A cover 8 is disposed on the sliding member 3 for sealingly covering the receiving space 33. The cover 8 has a shaft hole 82 axially defined therein and extendingly communicating with the receiving space 33. The shaft hole 82 is coaxial with the through hole 61 of the at least one ratchet wheel 6 and the opening 332 of the sliding member 3. The cover 8 has a pivot pin 81 formed thereon and axially extending toward the base 5. The pivot pin 81 sequentially passes through the pivotal end of the adjuster 37 and the pivot hole 51 of the base 5 for connecting the cover 8, the adjuster 37 and the base 5 together. The cover 8 has a second guiding slot 83 defined therein and located corresponding to the first guiding slot 53 of the base 5. The second guiding slot 83 has a shape corresponding to the first guiding slot 53. The protrusion 341 of the limiting member 34 passes through the second guiding slot 83 via the first guiding slot 53 for moving along the second guiding slot 83. The cover 8 has two directional indicators 84 respectively disposed on two ends of the second guiding slot 83.

A driving shaft 7 is partially received in the receiving space 33. The driving shaft 7 sequentially passes through the shaft hole 82 of the cover 8, the base 5, the through hole 61 of the at least one ratchet wheel 6 to be rotatably connected to the opening 332 of the sliding member 3. A rotating direction of the driving shaft 7 is indicated by the two directional indicators 84. The driving shaft 7 has a channel 71 defined therein and axially extending therethrough. The channel 71 is coaxial with the opening 332. One end of the driving shaft 7 has a plurality of flanges 72 annularly formed on an outer periphery thereof and radially located around the outer periphery thereof for correspondingly engaging with the grooves 62 of the at least one ratchet wheel 6.

Figure 4:
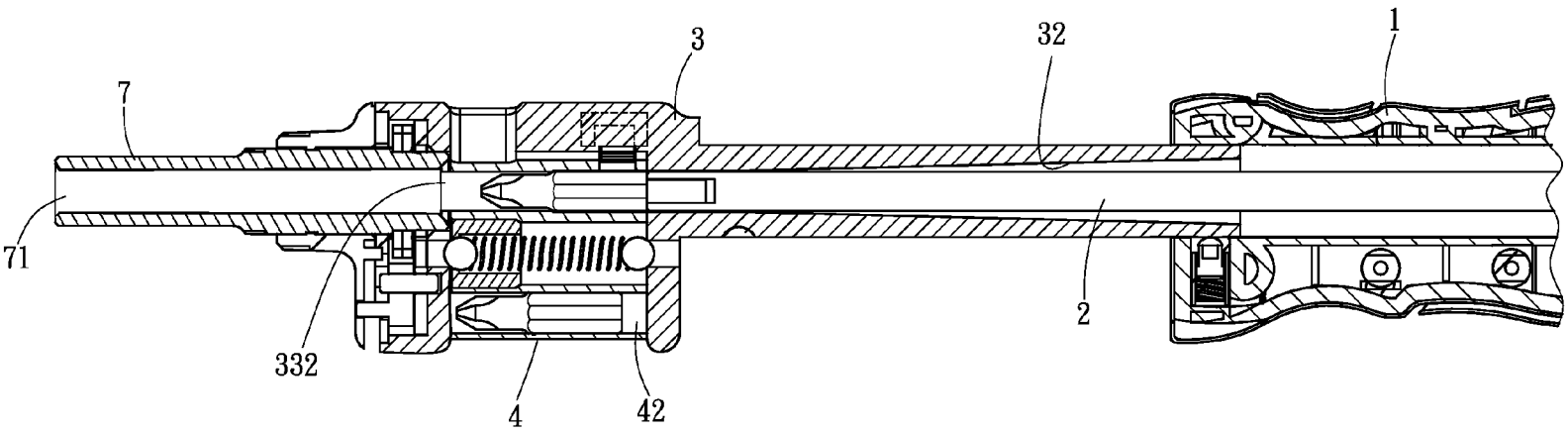
FIGS. 4-5 are operational partial cross-sectional views of the revolving screwdriver with ratchet structure in accordance with the present invention as a sliding member slides relative to a pushing rod.
Figure 5:
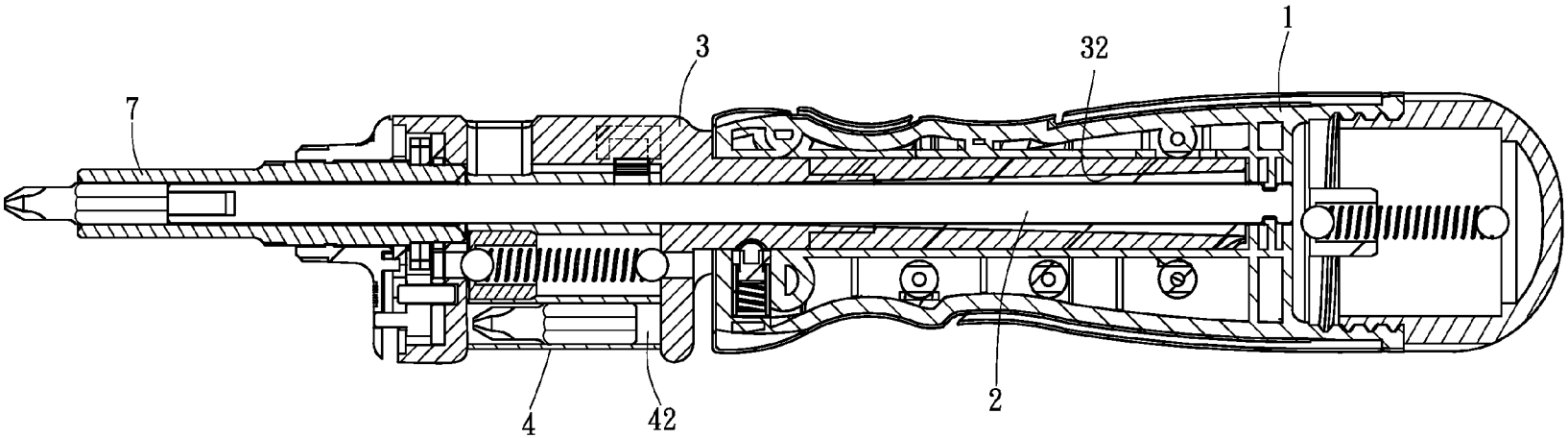

The operation of the revolving screwdriver with ratchet structure in accordance with the present invention will be described in detailed below. As shown in FIGS. 4-5, when the user wants to change to a desired tool bit, the user rotates the revolving cylinder 4 relative to the sliding member 3 until the corresponding containing hole 42 which the desired tool bit is received in is aligned with the sliding hole 32 and the opening 332. And the sliding member 3 axially slides relative to the pushing rod 2. The pushing rod 2 relatively moves along the sliding hole 32, the aligned containing hole 42 of the revolving cylinder 4, and the channel 71 of the driving shaft 7, such that the desired tool bit is pushed to partially protrude from the channel 71 of the driving shaft 7 by the pushing rod 2.

Figure 6:
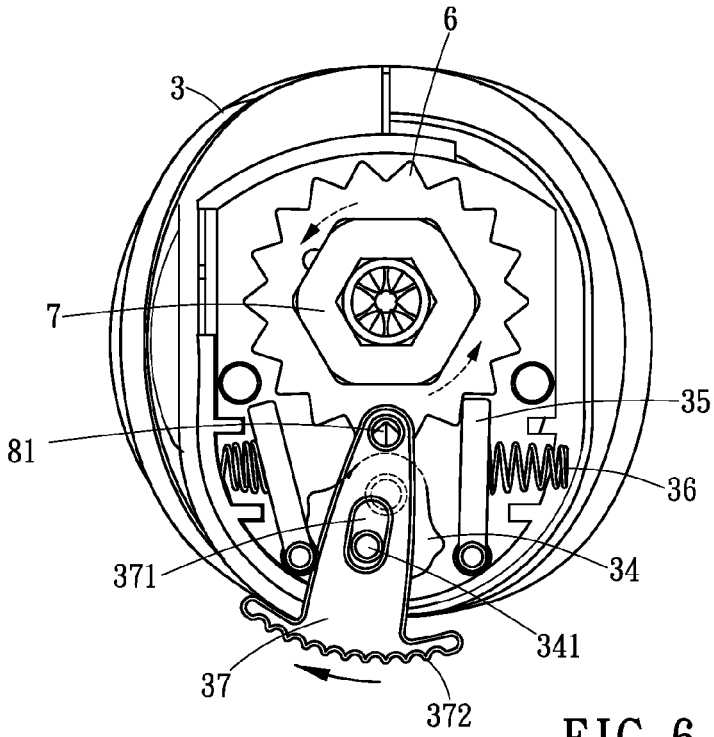
FIGS. 6-7 are operational cross-sectional views of the revolving screwdriver with ratchet structure in accordance with the present invention as an adjuster is pivotally moved to control a rotating direction of a driving shaft.
Figure 7:
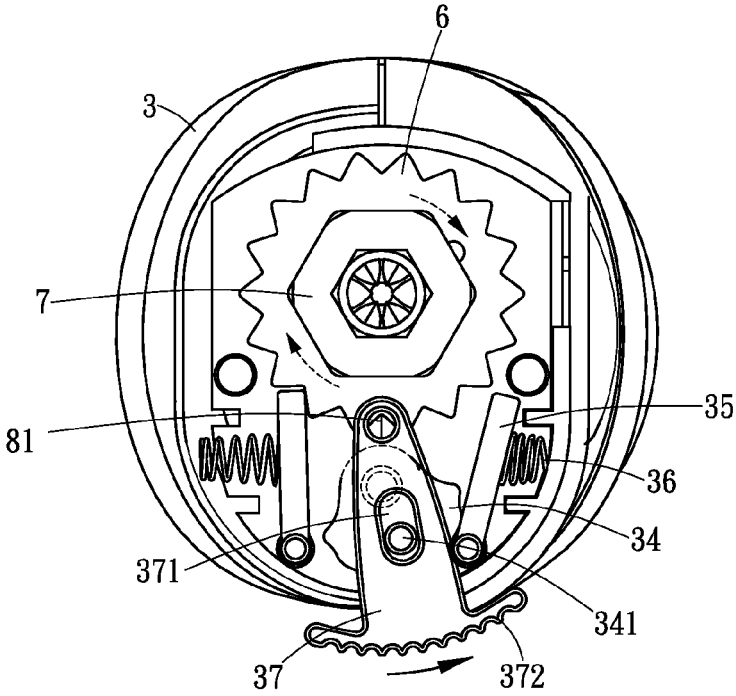

When the desired tool bit is ready to be operated, the user presses the teeth portion 372 of the adjuster 37 to pivotally move the adjuster 37 about the pivot pin 81 for controlling the one-way rotating direction of the driving shaft 7. As shown in FIG. 6, when the adjuster 37 is pivotally moved in a clockwise direction, the protrusion 341 of the limiting member 34 is restricted by the driving hole 371 and is pivotally moved in the clockwise direction by the adjuster 37. The corresponding rotator 35 is pressed by the limiting member 34 and the corresponding spring 36 is compressed by the corresponding rotator 35 for disengaging with the at least one ratchet wheel 6. Therefore, the driving shaft 7 which engages with the at least ratchet wheel 6 is restricted by the other rotator 35 and is able to pivotally rotate in an anti-clockwise rotating direction. The driving shaft 7 ratchetably drives the desired tool bit. As shown in FIG. 7, when the adjuster 37 is pivotally moved in the anti-clockwise direction, the limiting member 34 is pivotally moved in the anti-clockwise direction by the adjuster 37. The corresponding rotator 35 and spring 36 is pressed by the limiting member 34 for disengaging with the at least one ratchet wheel 6. Therefore, the driving shaft 7 is able to pivotally rotate in the clockwise rotating direction.

Although the invention has been explained in relation to its preferred embodiment, it is to be understood that many other possible modifications and variations can be made without departing from the spirit and scope of the invention as hereinafter claimed.

What is claimed is:

1. A revolving screwdriver with ratchet structure comprising:

a handle for adapting to be gripped by a user;

a pushing rod axially connected to the handle;

a sliding member axially and slidably connected to the pushing rod, the sliding member having a sliding hole axially defined therein and extending therethrough for sleeving on the pushing rod, the sliding member having a receiving space axially defined in one end thereof and the sliding hole formed an opening in a bottom of the receiving space, the sliding member having a holding chamber axially defined therein and located adjacent to the receiving space, the holding chamber communicating with the sliding hole;

a revolving cylinder rotatably and axially received in the holding chamber, the revolving cylinder having a center hole axially defined therein and extending therethrough for pivotally assembling within the holding chamber, the revolving cylinder having a plurality of containing holes axially defined therein and extending therethrough for adapting to receive tool bits, the containing holes radially spaced around the center hole, each containing hole selectively aligned with the sliding hole and the opening, such that the revolving cylinder is rotatable relative to the sliding member for changing to the desired tool bit;

at least one ratchet wheel rotatably received in the receiving space, the at least one ratchet wheel having a through hole axially defined therein and aligned with the opening of the sliding member, the through hole having a plurality of grooves axially defined in an inner periphery thereof;

two rotators pivotally received in the receiving space for selectively engaging with the at least one ratchet wheel, two springs compressibly received in the receiving space and respectively connected the two rotators, each spring having two ends respectively abutting against an inner periphery of the receiving space and the corresponding rotator;

a limiting member pivotally received in the receiving space and located between the two rotators, the limiting member having a protrusion axially formed thereon;

a base received in the receiving space, the at least one ratchet wheel, the limiting member, the two rotators and the two springs located between the base and a bottom of the receiving space, the base having an arc-shaped first guiding slot, a limiting hole and a pivot hole defined therein and axially extending therethrough, the limiting hole located between the first guiding slot and the pivot hole, the limiting member pivotally engaged with the limiting hole and the protrusion passing through the first guiding slot for moving along the first guiding slot;

an adjuster movably received in the receiving space and located exterior of the base, the adjuster having one end pivotally engaged with the pivot hole of the base, the adjuster having a driving hole defined therein and axially extending therethrough, the protrusion of the limiting member passing through the driving hole for being driven by the adjuster; and a driving shaft sequentially passing through the base and the through hole of the at least one ratchet wheel to be rotatably connected to the sliding member, the driving shaft partially received in the receiving space and axially aligned with the opening, one end of the driving shaft having a plurality of flanges annularly formed on an outer periphery thereof for correspondingly engaging with the grooves of the at least one ratchet wheel;

whereby when the sliding member axially slides relative to the pushing rod, the pushing rod relatively moves along the sliding hole and the aligned containing hole of the revolving cylinder to push the corresponding tool bit into the driving shaft; when the adjuster is pivotally moved about the driving shaft, the protrusion of the limiting member is driven by the adjuster to move along the first guiding slot of the base, one of the two rotators pressed to compress the corresponding spring by the limiting member for disengaging the at least one ratchet wheel, such that the driving shaft is able to pivotally move with the at least one ratchet wheel in the corresponding rotating direction and ratchetably drives the desired tool bit.

2. The revolving screwdriver with ratchet structure as claimed in claim 1 further comprising a cover disposed on the sliding member for sealingly covering the receiving space, the cover having a shaft hole axially defined therein and extendingly communicating with the receiving space for partially receiving the driving shaft, the cover having a second guiding slot defined therein and located corresponding to the first guiding slot of the base, the second guiding slot having a shape corresponding to the first guiding slot, the protrusion of the limiting member passing through the second guiding slot via the first guiding slot for moving along the second guiding slot, the cover having two directional indicators respectively disposed on two ends of the second guiding slot for indicating a rotating direction of the driving shaft.

3. The revolving screwdriver with ratchet structure as claimed in claim 1, wherein the sliding member has a recess laterally defined therein and communicating with the receiving space, the adjuster having an arc-shaped teeth portion laterally formed thereon and protruding from the recess.

4. The revolving screwdriver with ratchet structure as claimed in claim 2 further comprising a retainer disposed in the receiving space and located between the bottom of the receiving space and the at least one ratchet wheel, the retainer having two bores axially defined therein for respectively and pivotally engaging with the two rotators, the cover having a pivot pin formed thereon and axially extending toward the base, the pivot pin passing through the adjuster and the pivot hole of the base.

* * * * *